US005147581A

United States Patent [19]

Lu

[11] Patent Number: 5,147,581

[45] Date of Patent: Sep. 15, 1992

[54] NEW EVAPORATIVE AIR COOLER

[76] Inventor: Qiu-Jiang Lu, 740 E. 300 S. #101, Salt Lake City, Utah 84102

[21] Appl. No.: 650,209

[22] Filed: Feb. 4, 1991

[51] Int. Cl.[5] ..... B01D 47/00

[52] U.S. Cl. ..... 261/24; 261/91; 261/88; 62/314; 62/304

[58] Field of Search ..... 62/304, 314; 261/24, 261/89, 88, 91

[56] References Cited

U.S. PATENT DOCUMENTS 4,833,895 5/1989 Johnson ..... 62/304

4,977,756 12/1990 Brock ..... 62/314

*Primary Examiner*—Albert J. Makay

*Assistant Examiner*—John Sollecito

[57] ABSTRACT

An evaporative air cooler with a rotary fan blowing and evaporating droplets generated by an impeller, which shares the same motor shaft with the rotary fan. The evaporative air cooler comprises a housing (1) having rear inlets (23), front outlets (3), and a motor-supporting plate (6). An electric motor (7) is vertically mounted to the plate with its rotating shaft being directed downward and connected to a rotary fan (9). The rotary fan sucks, blows and evaporate droplets produced by an impeller (14) with blades (11) and a fluid-sucking tube (13).

8 Claims, 5 Drawing Sheets

NEW EVAPORATIVE AIR COOLER

This invention relates to an evaporative air cooler, and more particularly to an evaporative air cooler which uses a rotary fan to blow and evaporate water droplets produced by an impeller sharing the same motor shaft with the rotary fan.

GENERAL PURPOSES AND OBJECTS OF THE INVENTION

A main object of the invention is to provide a novel evaporative air cooler which efficiently utilizes a single electric motor to drive a rotary fan for blowing, and to spin an impeller for supplying and atomizing fluid.

A further object of the invention is to provide a novel evaporative air cooler which is relatively simple in construction, which is relatively economical in manufacturing, and which provides a great cooling capability with minimum consumption of electrical energy.

A still further object of the invention is to provide an evaporative air cooler which requires no fluid pump and cooler pad, which needs a relatively small amount of maintenance and which is reliable in operation.

DETAIL DESCRIPTION OF THE INVENTION

Figure 1:
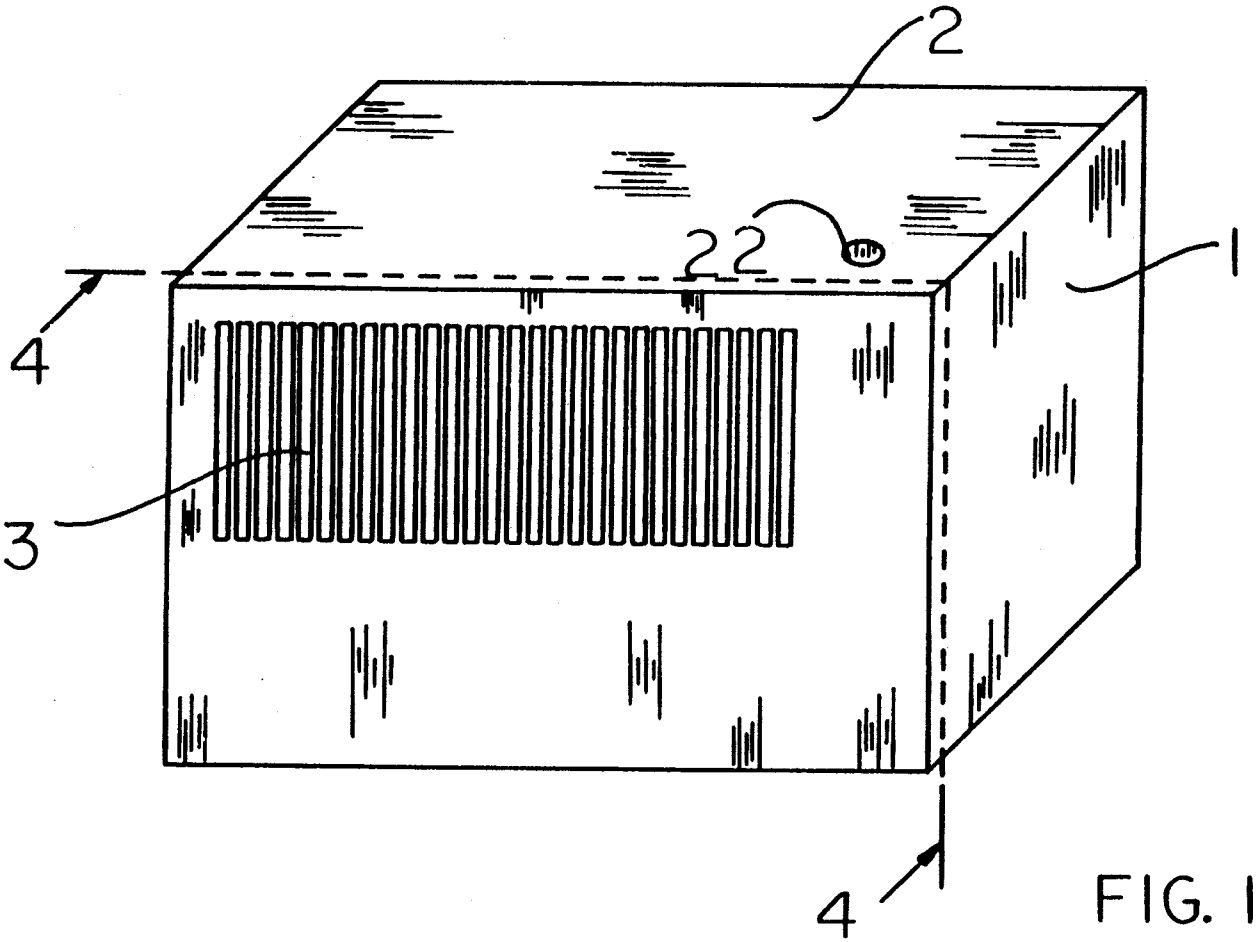
FIG. 1 is a perspective view of an evaporative air cooler constructed in accordance with the present invention.

Referring to the drawings, FIG. 1 designates a new evaporative air cooler constructed in accordance with the present invention. The cooler comprises a housing 1 having a cover 2, front outlets 3 and rear inlets 23, as shown in FIGS. 2 and 3.

Figure 2:
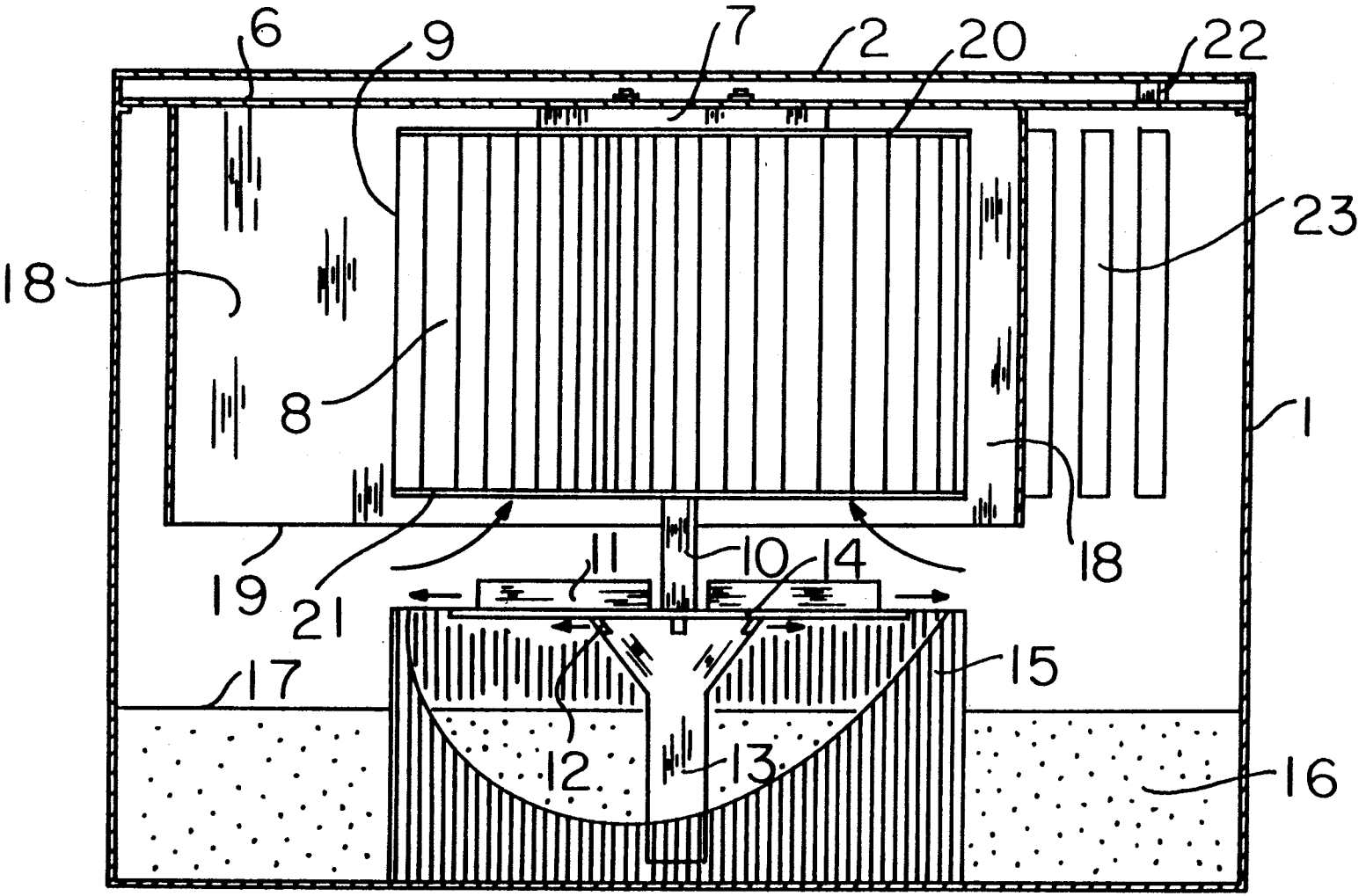
FIG. 2 is an enlarged vertical cross-sectional view taken substantially on the line 4—4 of FIG. 1.
Figure 3:
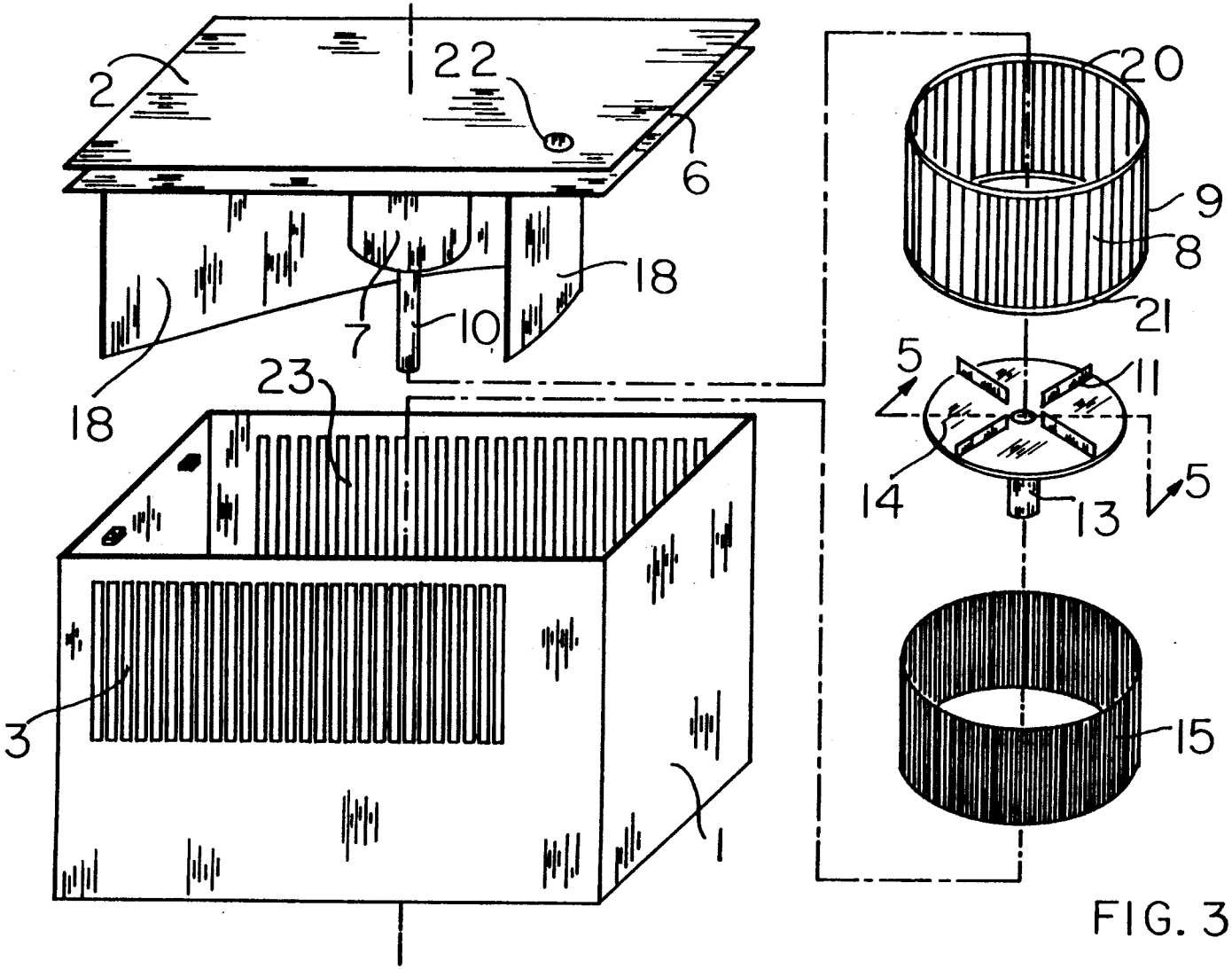
FIG. 3 is a perspective view of the elements comprising the cooler of FIGS. 1 and 2, said elements being shown in separated positions.
Figure 4:
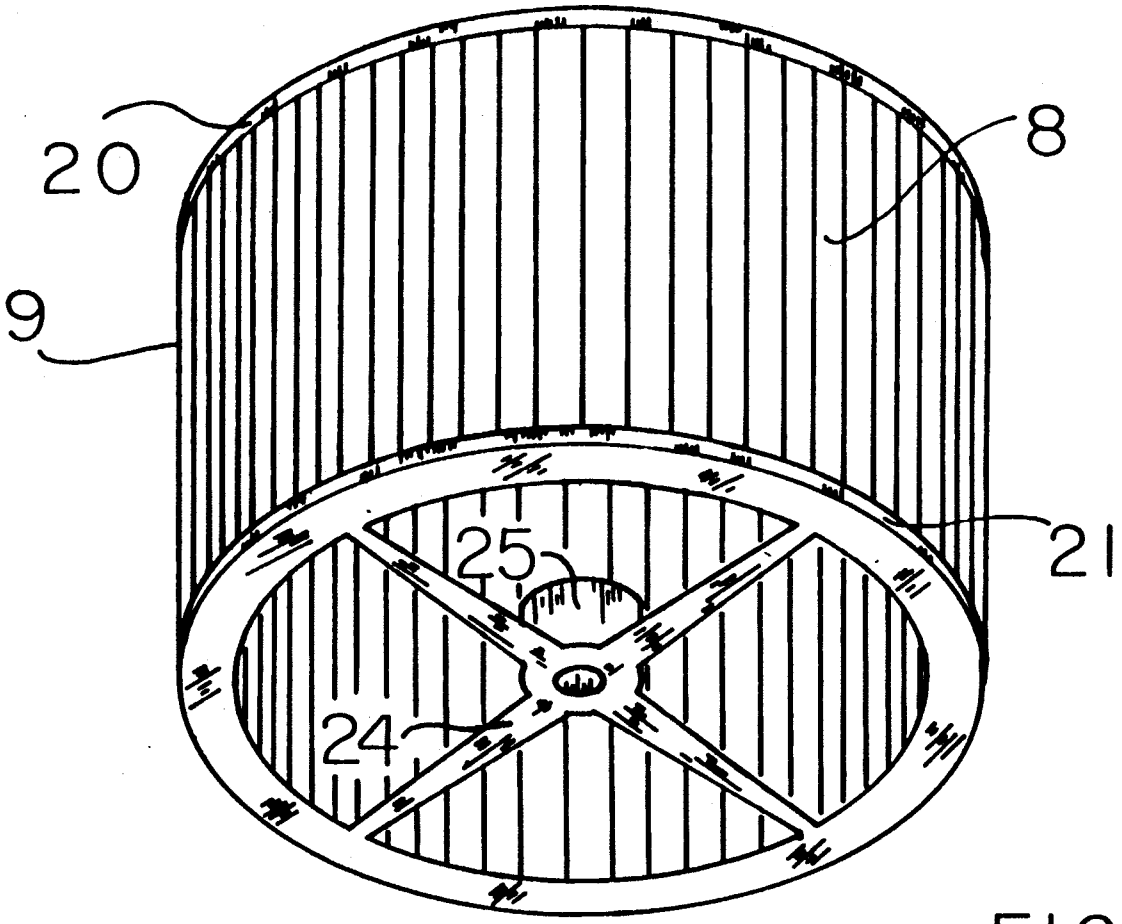
FIG. 4 is an enlarged perspective view of the rotary fan of FIGS. 2 and 3, showing the bottom of the rotary fan.
Figure 5:
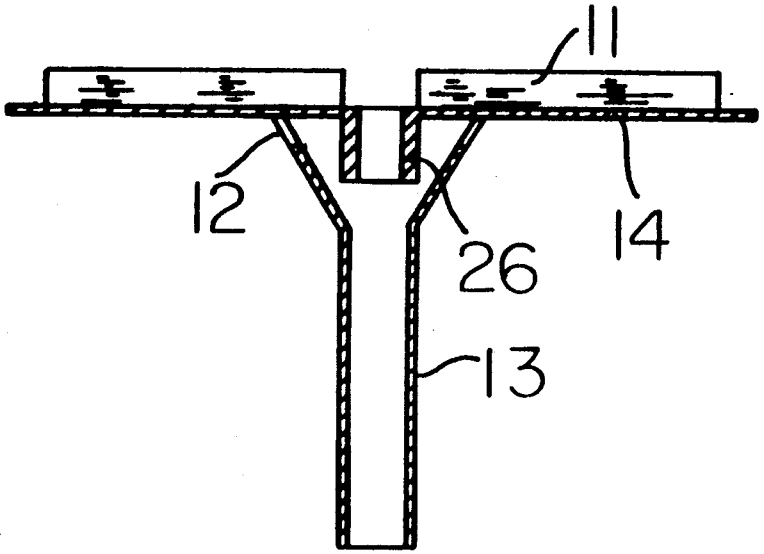
FIG. 5 is an enlarged vertical cross-sectional view of the impeller taken substantially on the line 5—5 of FIG. 3.

Horizontally mounted to said housing, as viewed in FIG. 2, is a motor-supporting plate 6, which supports an electric motor 7 whose rotating shaft 10 is directed downward and connected with a rotary fan 9 and an impeller 14, as by means of hubs 25 and 26 shown in FIGS. 4 and 5, respectively. Said rotary fan comprises vertically oriented fan blades 8, an upper ring 20 and a lower ring 21 connected to the hub 25 by spokes 24 as indicated in FIG. 4. Due to said motor-supporting plate blocking air flow, the such installed rotary fan, as viewed in FIG. 2, can suck air into the rotary fan only from below, and direct air out through gaps between the fan blades. Said impeller has blades 11, a fluid-sucking tube 13 and fluid outlets 12, and is surrounded by a cylindrical screen 15 mounted on the bottom of the housing 1.

As shown in FIG. 2, partially surrounding the rotary fan is an air flow guiding wall 18, which guides air sucked by said rotary fan to exit through the front outlets 3 as displayed in FIG. 1. The upper edge of the guiding wall is mounted to the motor-supporting plate 6 so that incoming air from the rear inlets 23 can be sucked by the rotary fan only from below the lower edge 19 of the guiding wall and above fluid surface 17. Fluid 16 is added through a fill pipe 22 and stored at the base portion of the housing 1.

DESCRIPTION OF OPERATION

In operation, the motor shaft 10 spins both the rotary fan 9 and the impeller 14, as shown in FIG. 2. The rotating fan creates a partial vacuum inside the fan. As a result, air outside the device flows into the housing 1 through the rear inlets 23 to fill the vacuum. Due to the blocking effects of the motor-supporting plate 6 and the guiding wall 18, all the incoming air flows below the lower edge 19 of the guiding wall, and blows over the fluid surface 17, resulting in fast evaporation on the fluid surface which cools the incoming air.

Another even stronger cooling factor provided by the device is the atomizing effect. When the impeller 14 spins, it sucks the fluid 16 through the sucking tube 13. The impeller then forces the sucked fluid to exit through the outlets 12 and impact the screen 15, generating fine droplets. The mist comprised of the fine droplets can not escape from the rear inlets 23 due to the sucking effect of the rotary fan. Once droplets are produced, they are sucked into the rotary fan from below the lower ring 21, and blown out through the guiding wall 18 and the front outlets 3. The droplets that have exited evaporate quickly and cool their ambient air due to the strong blowing and ventilation provided by the rotary fan.

It is noted that the spinning action of the impeller itself can produce droplets, and that the impacts between the fan blades 8 and droplets sucked by the rotary fan can further break larger droplets. Therefore, the use of the screen 15 is not mandatory.

The fluid level can be indirectly monitored by the outgoing droplets. When the production of droplets stops or cooling capacity drops drastically, it is time to refill the cooler.

While a specific embodiment of a novel evaporative air cooler has been disclosed in the foregoing description, it will be understood that various modifications within the spirit of the invention may occur to those skilled in the art. Therefore, it is intended that no limitations be placed on the invention except as defined by the scope of the following claims.

What is claimed is:

1. In an evaporative air cooler comprising a housing having rear inlets, front outlets, a cover and a motor-supporting plate, an electric motor being mounted to said plate with its shaft being directed downward, a rotary fan with its blades being vertically oriented and retained by an upper ring and a lower ring, said fan having a hub connected to said lower ring by spokes, said fan being connected to said motor shaft through said hub, an impeller having blades, a fluid-sucking tube, fluid outlets, and a hub, said impeller being situated below said rotary fan and being mounted to said motor shaft through said impeller hub, an air flow guiding wall partially surrounding said rotary fan with its upper edge being connected to said motor-supporting plate, a cylindrical screen surrounding said impeller and being mounted on the bottom of said housing, and a fluid fill pipe being directed downward from said cover and going through said motor-supporting plate.

2. An evaporative air cooler as defined in claim 1, wherein the rotary fan and the impeller share the same motor shaft.

3. An evaporative air cooler as defined in claim 1, wherein the blades of the impeller are situated below the lower ring of the rotary fan and above the surface of fluid stored at the base portion of the housing.

4. An evaporative air cooler as defined in claim 1, wherein a lower edge of the air flow guiding wall is lower than the lower ring of the rotary fan, but higher than the blades of the impeller.

5. An evaporative air cooler as defined in claim 1, wherein the motor shaft is directed downward, and the rotary fan is mounted to the motor shaft through the hub connected to the lower ring of the fan by the spokes so that air can be sucked into the rotary fan from below.

6. An evaporative air cooler as defined in claim 1, wherein the motor-supporting plate is above the upper ring of the rotary fan so that air can be allowed to enter the rotary fan only from below the lower ring of the rotary fan.

7. An evaporative air cooler as defined in claim 1, wherein air flow is converged into the rotary fan only from below the lower edge of the guiding wall and above the surface of fluid stored at the base portion of the housing.

8. An evaporative air cooler as defined in claim 1, wherein the rotary fan sucks, blows and evaporates droplets produced by the impeller that shares the same motor shaft with the rotary fan.

* * * * *